US011505377B2

(12) United States Patent
Mcpherson et al.

(10) Patent No.: US 11,505,377 B2
(45) Date of Patent: Nov. 22, 2022

(54) TAMPER-EVIDENT CLOSURE COMPRISING A RFID TAG

(71) Applicant: GCL International S.A.R.L., Luxembourg (LU)

(72) Inventors: Alexander Donald Meiklem Mcpherson, Falkirk (GB); Marco Antonelli, Edinburgh (GB)

(73) Assignee: GCL International S.A.R.L, Luxembourg (LU)

( * ) Notice: Subject to any disclaimer, the term of this patent is extended or adjusted under 35 U.S.C. 154(b) by 0 days.

(21) Appl. No.: 17/261,157

(22) PCT Filed: Jul. 29, 2019

(86) PCT No.: PCT/EP2019/070341
§ 371 (c)(1),
(2) Date: Jan. 18, 2021

(87) PCT Pub. No.: WO2020/025531
PCT Pub. Date: Feb. 6, 2020

(65) Prior Publication Data

US 2021/0276772 A1 Sep. 9, 2021

(30) Foreign Application Priority Data

Aug. 1, 2018 (EP) ..... 1812531

(51) Int. Cl.
*B65D 55/02* (2006.01)

(52) U.S. Cl.
CPC ..... *B65D 55/028* (2013.01); *B65D 55/022* (2013.01); *B65D 55/026* (2013.01)

(58) Field of Classification Search
CPC .. B65D 55/028; B65D 55/022; B65D 55/026; B65D 2203/10
See application file for complete search history.

(56) References Cited

U.S. PATENT DOCUMENTS

2014/0367295 A1* 12/2014 Murray ..... G06K 19/07749 493/187
2015/0363686 A1 12/2015 Yang
(Continued)

FOREIGN PATENT DOCUMENTS

KR 100967340 B1 * 1/2010 ..... B65D 49/12
KR 100967340 B1 7/2010
(Continued)

*Primary Examiner* — Anthony D Stashick
*Assistant Examiner* — L Kmet
(74) *Attorney, Agent, or Firm* — Lightbulb IP, LLC

(57) ABSTRACT

A tamper-evident closure (101) for a container neck comprises a first portion (105, 106), a second portion (102, 104) comprising a window (103) through which a view of the first portion is visible, a locking mechanism, and an RFID device (107) associated with the first portion (105, 106). The second portion (102, 104) is rotatable relative to the first portion (105, 106) upon first opening of the tamper-evident closure (101) from a first position in which the first and second portions (105, 106; 102, 104) are in a first relative relation and the RFID device (107) is aligned with the window (103) and is readable, to a second position in which the first and second portions (105, 106; 102, 104) are in a second relative relation and the RFID device (107) is masked by the second portion (102, 104) and is not readable.

17 Claims, 13 Drawing Sheets

(56) References Cited

U.S. PATENT DOCUMENTS

| | | | |
|---|---|---|---|
| 2017/0137189 | A1 | 5/2017 | McPherson |
| 2017/0193347 | A1 | 7/2017 | Enguent |

FOREIGN PATENT DOCUMENTS

| | | | |
|---|---|---|---|
| KR | 20100123200 | A | 11/2010 |
| KR | 20110086655 | A | 7/2011 |
| WO | WO2017/093218 | A1 | 6/2017 |

* cited by examiner

TAMPER-EVIDENT CLOSURE COMPRISING A RFID TAG

FIELD OF THE INVENTION

The present invention relates generally to a closure for a container neck, and more particularly to a tamper-evident closure with means for indicating that the closure has been opened at least once and with an identification device.

BACKGROUND OF THE INVENTION

There is an increasing demand for tamper-indicating systems which ensure that a container is not re-filled with non-original contents. Whilst it is relatively easy to produce some form of tamper-evidence, it is much more difficult to provide a closure with tamper-evidence which cannot be either overcome without causing the tamper-evidence system to activate, or to be activated and then returned to a virtually visually identical state so as to appear non-activated.

A particularly useful method of providing tamper-evidence is to use a system in which a closure is initially located in a first position, but once removed can only be returned to a second position which is visually distinct from the first. Such tamper-evident systems are only effective if they cannot be reversed. For example, in systems which use an obstructing member to hold two parts apart it is possible to cut the obstruction to allow a gap to be closed.

International Patent Publication Nos. WO 2005/049443 and WO 2006/117505 describe closures which generate a gap upon first opening of the closure to indicate that the closure has been opened at least once. The closures generate unobstructed gaps following relative rotation of one part with respect to another. In other words, two parts of the closure are held apart without the requirement of an obstruction. The closures are provided with some internal mechanism for preventing the two parts from being rotated back to their original relative positions.

It is also known to provide a closure with a radio-frequency identification (RFID) tag, which contains electronically-stored information that can be ascertained using an appropriate reading device via radio waves. The stored data can be used to identify item details and/or in item tracking. RFID tags may be read only or read/write. RFID tags may be active, whereby the device is powered by a battery and actively transmits a signal for detection by a reading device, or passive, whereby the device is activated to transmit a signal upon receiving RF energy emitted by a reading device.

International Patent Publication No. WO 2006/120379 A1 discloses a metal closure and RFID device in combination, wherein the closure comprises an electrically-conductive shell, and the RFID device comprises a tag and antenna means, the tag comprises an RFID chip and the antenna means is one side of a dipole, the RFID device being entirely located within the metal closure and electrically coupled to the metal closure so that the metal closure becomes the other side of the dipole.

A type of RFID technology is near field communication (NFC), which is a set of communication protocols allowing short-range, low-power wireless connectivity between two electronic devices.

It is an object of the present invention to provide further improvements relating to a closure for a container neck.

SUMMARY OF THE INVENTION

According to a first aspect there is provided a tamper-evident closure for a container neck, the tamper-evident closure comprising: a first portion, and a second portion comprising a window through which a view of the first portion is visible; the second portion rotatable relative to the first portion upon first opening of the tamper-evident closure, in a first direction of rotation, from a first position in which the first and second portions are in a first relative relation to a second position in which the first and second portions are in a second relative relation; and a locking mechanism for irreversibly locking the first and second portions in the second relative relation; rotation of the second portion relative to the first portion causes rotation of the window relative to the first portion, a first view of the first portion is visible through the window when the first and second portions are in the first relative relation, and a second, different view of the first portion is visible through the window when the first and second portions are in the second relative relation; wherein the tamper-evident closure further comprises an RFID device associated with the first portion, the RFID device is aligned with the window of the second portion when the first and second portions are in the first relative relation and is readable, and the RFID device is masked by the second portion when the first and second portions are in the second relative relation and is not readable; whereby the readability of the RFID device is irreversibly blocked during first opening of the tamper-evident closure.

The RFID device may be an NFC tag.

During first opening of the tamper-evident closure, the locking mechanism may irreversibly lock the first portion and the second portion in the second relative relation and thereafter the first and second portions may be removable together.

The second portion may comprise a shell in which the window is defined. The shell may comprise a top plate and a side skirt, with the window defined in the side skirt.

The window may be an aperture or a cut-out.

The shell may comprise aluminium.

The first portion may comprise a sleeve comprising a first zone provided with the RFID device and a second zone that differs from the first zone.

The sleeve may comprise a plastics material.

The locking mechanism may comprise a ratchet arrangement. The locking mechanism may comprise an inner ratchet element and an outer ratchet element, the first portion comprising the inner ratchet element and the second portion comprising the outer ratchet element.

The tamper-evident closure may comprise a first part, and a second part, when the first and second portions are in the first relative relation, prior to first opening of the tamper-evident closure, the first and second parts are adjacent one another, and when the first and second portions are moved into the second relative relation, during first opening of the tamper-evident closure, an irreversible gap is generated between the first and second parts.

The first and second parts may be upper and lower shell parts. The upper shell part may form a removable cap part and the lower shell part may form a captive part that remains on the container neck when the removable cap part is removed.

The gap may be unobstructed.

The first portion may be removably engageable with a body portion for fixing to a container neck. The body portion may comprise a pouring fitment. The pouring fitment may comprise a non-return valve.

The window may comprise more than one opening.

The tamper-evident closure may further comprise a second RFID device associated with the first portion, when the first and second portions are in the first relative relation, the RFID device is aligned with the window of the second portion and is readable and the second RFID device is masked by the second portion and is not readable, and when the first and second portions are in the second relative relation, the RFID device is masked by the second portion and is not readable and the second RFID device is aligned with the window of the second portion and is readable; whereby the readability of the RFID device and of the second RFID device is irreversibly changed during first opening of the tamper-evident closure.

The second RFID device may be an NFC tag.

According to a second aspect there is provided a container neck provided with a tamper-evident closure according to the first aspect.

Further particular and preferred aspects of the invention are set out in the accompanying dependent claims.

BRIEF DESCRIPTION OF THE DRAWINGS

The present invention will now be more particularly described, with reference to the accompanying drawings, in which.

DESCRIPTION

Figure 1:
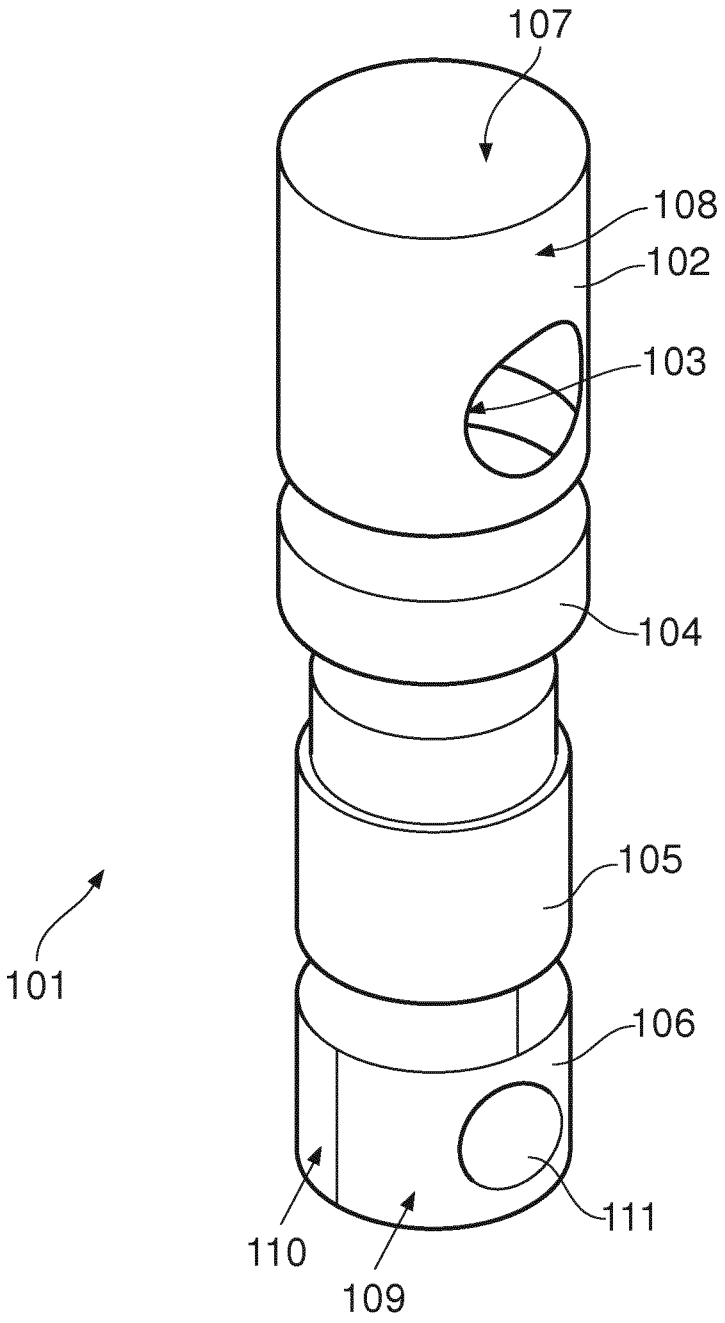
FIG. 1 shows an exploded schematic view of components of a closure according to an embodiment of the present invention.

Example embodiments are described below in sufficient detail to enable those of ordinary skill in the art to embody and implement the apparatus, systems and processes herein described. It is important to understand that embodiments of the invention can be provided in many alternate forms and the invention should not be construed as limited to the examples set forth herein but by the scope of the appended claims.

Unless otherwise defined, all terms (including technical and scientific terms) used herein are to be interpreted as is customary in the art. In addition, features referred to herein in the singular can number one or more, unless the context clearly indicates otherwise. Similarly, the terms "comprises", "comprising", "includes", "including", "has" and/or "having" when used herein, specify the presence of the stated feature or features and do not preclude the presence or addition of one or more other features, unless the context clearly indicates otherwise.

The present invention provides a closure for a container neck. The closure comprises a first portion, and a second portion comprising a window through which a view of the first portion is visible. The second portion is rotatable relative to the first portion upon first opening of the closure, in a first direction of rotation, from a first position in which the first and second portions are in a first relative relation to a second position in which the first and second portions are in a second relative relation. The closure further comprises a locking mechanism for irreversibly locking the first and second portions in the second relative relation. Rotation of the second portion relative to the first portion causes rotation of the window relative to the first portion. A first view of the first portion is visible through the window when the first and second portions are in the first relative relation, and a second, different view of the first portion is visible through the window when the first and second portions are in the second relative relation. The view of the first portion through the window of the second portion is irreversibly changed during first opening of the tamper-evident closure. This change in the view of the first portion that can be seen through the window of the second portion provides an effective tamper-evident feature.

In an embodiment, the first view of the first portion is associated with a radio-frequency identification (RFID) device that is readable when the first and second portions are in the first relative relation. The RFID device is not readable when the first and second portions are in the second relative relation. The RFID device may be any suitable type. Preferably the RFID device is a near-field communication (NFC) device. The NFC device may be any suitable type.

In an embodiment, the first view of the first portion is associated with a first RFID device that is readable when the first and second portions are in the first relative relation and the second view of the second portion is associated with a second RFID device that is readable when the first and second portions are in the second relative relation. The second RFID device is not readable when the first and second portions are in the first relative relation and the first RFID device is not readable when the first and second portions are in the second relative relation. Preferably each of the first and second RFID devices is a near-field communication (NFC) device.

The present invention provides a tamper-evident closure for a container neck, the tamper-evident closure comprising a first portion, a second portion comprising a window through which a view of the first portion is visible, a locking mechanism, and an RFID device associated with the first portion. The second portion is rotatable relative to the first portion upon first opening of the tamper-evident closure from a first position in which the first and second portions are in a first relative relation and the RFID device is aligned with the window and is readable, to a second position in which the first and second portions are in a second relative relation and the RFID device is masked by the second portion and is not readable.

An exploded schematic view of components of a tamper-evident closure 101 is shown in FIG. 1 . In this embodiment, the tamper-evident closure 101 has a substantially circular cross-sectional shape.

Tamper-evident closure 101 comprises a shell 102 in which a window 103 is defined, an outer component 104, an inner component 105 and a sleeve 106. In this example, the shell 102 comprises a top plate 107 and a side skirt 108, and the window 103 is defined in the side skirt 108.

In this embodiment, the shell 102 is a metal shell. In a specific embodiment, the shell 102 is an aluminium shell. In an alternative embodiment, the shell 102 comprises a metal layer.

In the present example, the window 103 is an aperture. In an alternative example, the window is a cut-out. The shape of the cut-out may have an open side, for example where a length of the lower edge of the shell is, in effect, missing. It is therefore to be understood that the window may or may not have a continuous boundary edge that defines a closed shape. In this specific example, the window 103 is a substantially circular aperture; however, an aperture or cut-out may have any suitable shape. Furthermore, the window may comprise more than one aperture or cut-out or a combination thereof. The window may comprise a single opening or a plurality of openings, which may be openings in a mesh-like arrangement or in the form of slots or slits. Each opening of a plurality of openings of a window may have any suitable shape and dimensions. In the present example, the window is uncovered. In an alternative example, the window is covered, for example by a pane formed from a sheet of a transparent plastics material.

According to the present example, the sleeve 106 comprises a first zone 109 and a second zone 110 that is different from the first zone 109. In this example, the first zone 109 has a first appearance and the second zone 110 has a second appearance that differs from the first appearance of the first zone 109. In an alternative example, the sleeve 106 comprises more than two zones, which may each have a different appearance to the others. It is to be appreciated that regions of first and second zones that are immediately adjacent each other or that are spaced apart may be visible through the window before 103 and after first opening of the tamper-evident closure 101. In this example, the sleeve 106 has a continuous perimeter. In an alternative example, the sleeve does not have a perimeter that forms a closed shape. The sleeve may thus be provided by an annular collar or a strip, which may have a pre-formed profile, or may be formable into a profile, suitable for application to or incorporation within another component.

At least one of the zones of the sleeve is associated with an RFID device, which is preferably an NFC device.

According to the present embodiment, the first zone 109 of sleeve 106 is provided with an NFC tag 111. The NFC tag 111 may be embedded within, or affixed onto, the sleeve 106 in any suitable way. The presence of the NFC tag 111 may be overt or may be disguised.

Figure 2:
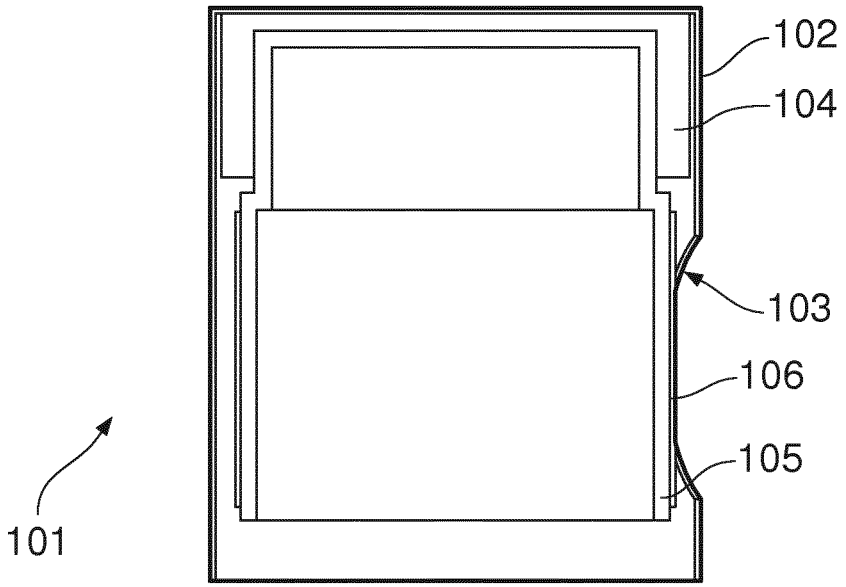
FIG. 2 shows an assembled schematic side view of the components of FIG. 1.

An assembled schematic side view of the shell 102, outer component 104, inner component 105 and sleeve 106 is shown in FIG. 2.

According to the shown arrangement, the outer component 104 is secured within the shell 102. In an example, the outer component 104 is adhered to the inside of the shell 102. Any suitable way of fixing the outer component 104 within the shell 102 may be used. In the illustrated arrangement, the outer component 104 is located at the top of the shell 102. In addition, according to the shown arrangement, the sleeve 106 is secured to inner component 105. In an example, the sleeve 106 is adhered to the outside of the inner component 105. Any suitable way of fixing the sleeve 106 around the inner component 105 may be used. In the arrangement shown in this Figure, the sleeve 106 tightly surrounds the inner component 105. The sleeve 106 may be located within a recessed region of the external surface of the inner component 105, and the external surface of the sleeve 106 may then be flush with the external surface of the inner component 105.

As can be seen in this Figure, the tamper-evident closure 101 is arranged such that a view of the sleeve 106 is visible through the window 103.

In the shown arrangement, the outer component 104 is rotatable around the inner component 105.

In this embodiment, a first portion of the tamper-evident closure 101 comprises inner component 105 and sleeve 106 and a second portion of the tamper-evident closure 101 comprises shell 102 and outer component 104.

It is to be appreciated that with the shell 102 and outer component 104 in fixed relative relation, and with the sleeve 106 and inner component 105 also in fixed relative relation, rotation of the shell 102 causes rotation of the window 103 relative to the sleeve 106.

Thus, in this embodiment, rotation of the second portion 102, 104 relative to the first portion 105, 106 causes rotation of the window 103 relative to the first portion 105, 106.

As will be described in further detail below, the second portion 102, 104 is rotatable relative to the first portion 105, 106 upon first opening of the tamper-evident closure 101, in a first direction of rotation, from a first position in which the first and second portions 105, 106; 102, 104 are in a first relative relation to a second position in which the first and second portions 105, 106; 102, 104 are in a second relative relation, and the tamper-evident closure 101 comprises a locking mechanism for irreversibly locking the first portion and second portions 105, 106; 102, 104 in the second relative relation.

Figure 3:
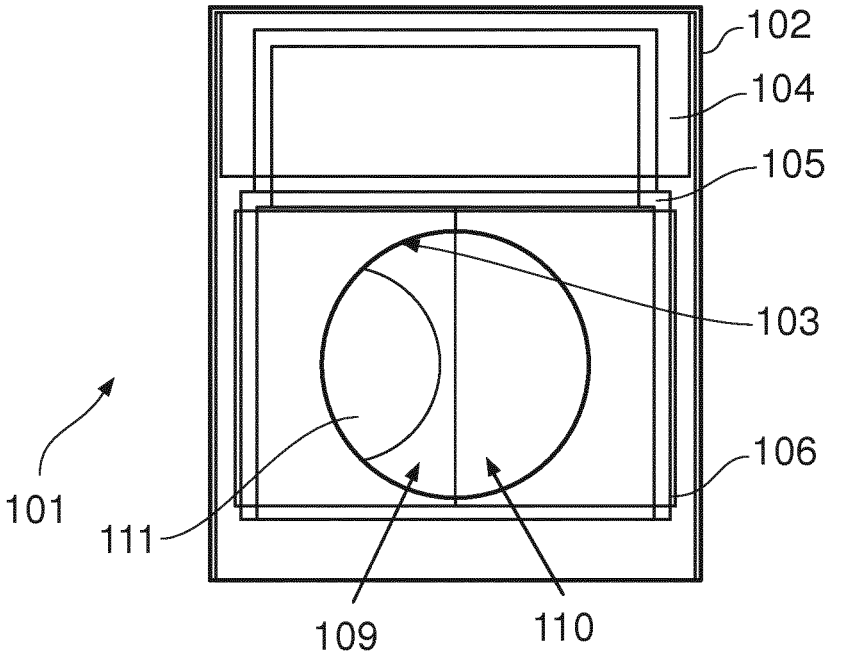
FIG. 3 shows an assembled schematic front view of the components of FIG. 1.

An assembled schematic front view of the shell 102, outer component 104, inner component 105 and sleeve 106 is shown in FIG. 3. It can be seen clearly from this Figure that a view of the first portion 105, 106 of the tamper-evident closure 101 is visible through the window 103 of the second portion 102, 104. A view of the sleeve 106, which in this specific illustration comprises both a region of the first zone 109 and a region of the second zone 110, is visible through the window 103 of sleeve 102.

The tamper-evident closure 101 is arranged such the view of the first portion that is visible through the window 103 of the second portion irreversibly changes during first opening of the tamper-evident closure 101.

In the present embodiment, the change in the view that is visible through the window 103 comprises a change of colour.

In this example, the first zone 109 of the sleeve 106 presents a first colour presentation and the second zone 110 of the sleeve 106 presents a second colour presentation that is different from the first colour presentation. In this specific example, the first zone 109 presents a yellow colour and the second zone 110 presents a red colour. Any combination of single colour zones, mixed colour zones or a combination thereof may be used. In this specific example also, there is a distinct transition boundary 111 between the two different colours of the first and second zones 109, 110. In an alternative example, there is a smooth, blended transition between the colours. The transition from one region, area or zone to another may be sharp or blurred, and different transition types may be used between different regions, areas or zones.

In addition, as mentioned previously, an NFC tag 111 is associated with the first zone 109. When the first and second portions 105, 106; 102, 104 are in the first relative relation, the NFC tag 111 is aligned with the window 103 and is readable; however, when the first and second portions 105, 106; 102, 104 are in the second relative relation, the NFC tag 111 is masked behind the shell 102 and is no longer readable.

Figure 4:
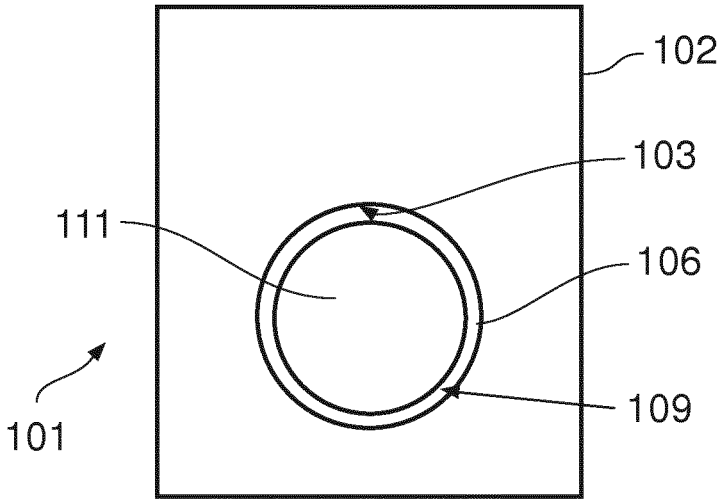
FIG. 4 shows the closure of FIGS. 1 to 3 prior to first opening.

FIG. 4 shows tamper-evident closure 101 prior to first opening. Before the tamper-evident closure 101 has been opened for the first time, the first and second portions of the tamper-evident closure 101 are in a first relative relation and a first view of the first portion is visible through the window 103. In this illustrated example, when the first and second portions are in the first relative relation, the view of the first portion that is visible through the window 103 of the shell 102 comprises only a region of the first zone 109 of the sleeve 106. In this specific example, the colour yellow is therefore showing in the window 103.

In addition, in this specific embodiment, in this illustrated example, when the first and second portions are in the first relative relation, prior to first opening of the tamper-evident closure 101, the NFC tag 111 associated with the first zone 109 of the sleeve 106 is aligned with the window 103 and is readable.

To open the tamper-evident closure 101, the shell 102 is rotated in a first direction of rotation, in this example in an anti-clockwise direction. This causes the window 103 to be rotated around sleeve 106.

Figure 5:
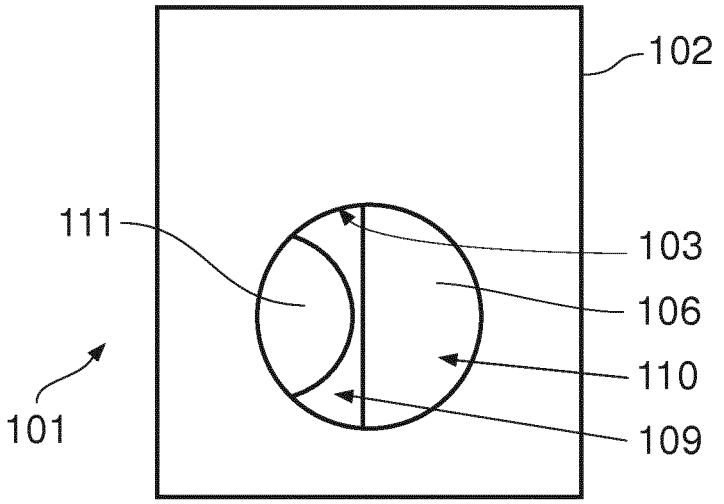
FIG. 5 shows the closure of FIGS. 1 to 3 at a first stage during first opening.

FIG. 5 shows tamper-evident closure 101 at a first stage during first opening. At the shown first stage, the shell 102 has been rotated from the first position shown in FIG. 4, in which the first and second portions are in a first relative relation before opening of the tamper-evident closure 101, towards a second position, in which the first and second portions are in a second relative relation. In FIG. 5, the shell 102 is shown at an intermediate position, between the first position and the second position.

It can be seen from comparison of FIG. 5 with FIG. 4 that the view of the first portion that is visible through the window 103 has changed, following the change of position of the shell 102.

In this illustrated example, the view of the first portion that is visible through the window 103 of the shell 102, following rotation of the shell 102 to the intermediate position shown in FIG. 5, comprises a region of the first zone 109 of the sleeve 106 and also a region of the second zone 110 of the sleeve 106. In this specific example, both the colours yellow and red are therefore showing in the window 103.

In addition, in this illustrated example, when the first and second portions are in the intermediate position shown in FIG. 5, the NFC tag 111 of the first zone 109 of the sleeve 106 is no longer aligned with the window 103 and may no longer be readable.

Figure 6:
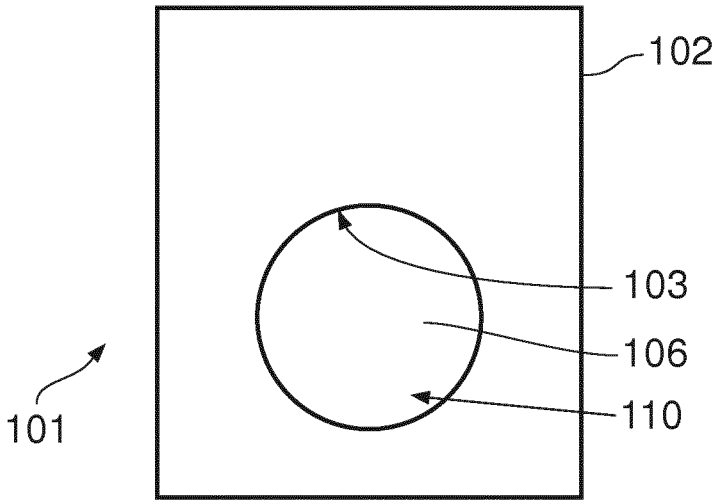
FIG. 6 shows the closure of FIGS. 1 to 3 at a second, subsequent stage during first opening.

FIG. 6 shows tamper-evident closure 101 at a second, subsequent stage during first opening. At the shown second stage, the shell 102 has been rotated from the intermediate position shown in FIG. 5, into the second position, in which the first and second portions are in a second relative relation.

It can be seen from comparison of FIG. 6 with FIG. 5 that the view of the first portion that is visible through the window 103 has changed again, following the change of position of the shell 102.

In this illustrated example, the view of the first portion that is visible through the window 103 of the shell 102, following rotation of the shell 102 to the second position shown in FIG. 6, comprises only a region of the second zone 109 of the sleeve 106. In this specific example, the colour red is therefore showing in the window 103.

In addition, in this illustrated example, when the first and second portions are in the second position shown in FIG. 6, the NFC tag 111 of the first zone 109 of the sleeve 106 is masked behind the shell 102 and is not readable.

Thus, in this embodiment, the detectability of the NFC tag 111 of the closure 101 indicates that the closure 101 has not been opened before.

Thus, during first opening of the tamper-evident closure 101, the view through the window 103 changes from a first colour presentation, in this specific example yellow, to a second colour presentation, in this specific example red. It is to be appreciated that any combination of colours may be used and also that additionally or alternatively to colour, alphanumeric text, graphics, patterns, pictures, surface finishes and/or textures may be used to provide or contribute to the changing view. More than one different view may be shown during the opening of the tamper-evident closure. By way of example, the view may change from red, to orange, to green during first opening. By way of further example, the view may comprise stripes that change in spacing and/or thickness and/or colour during first opening.

The use of the window and a view that changes during the initial opening of the closure provides a simple and effective form of tamper-evidence. It is to be appreciated that there may be two or more than two different stages in the change of appearance during the opening event of the tamper-evident closure.

In addition, during first opening of the tamper-evident closure 101, the readability of the NFC tag 111 changes from readable to non-readable. As explained above, this is because the NFC tag 111 is blocked from being read by the shell 102 of the closure 101. In other words, it is the shell 102 masking the NFC tag 111 that prevents the NFC tag 111 from being read and not, for example, the result of any change in or damage to the NFC tag 111 caused by the rotation of the second portion relative to the first portion during first opening of the closure 101.

It is to be appreciated that the change in view during initial opening of the closure may be provided solely by the disappearance of an RFID device, such as an NFC tag, that is visually detectable prior to first opening of the closure.

As mentioned previously, the tamper-evident closure 101 comprises a locking mechanism for irreversibly locking the first and second portions in the second relative relation and, in turn, irreversibly locking the corresponding second view of the first portion in the window 103.

In this embodiment, the first and second portions of the tamper-evident closure 101 together form a cap, the locking mechanism irreversibly locks the first portion and the second portion in the second relative relation and thereafter the first and second portions are removable together.

According to the arrangement of tamper-evident closure 101:

Before the cap is opened:

The initial first (yellow) colour of the first zone 109 is visible (indicating that the cap has not been opened or tampered with) and the NFC tag 111 associated with the first zone 109 is readable Once the cap opening sequence begins:

The shell 102 rotates around the sleeve 106 to obscure the initial first (yellow) colour and reveal the subsequent second (red) colour, and to conceal the NFC tag 111;

The inner and outer components engage to lock the first and second portions of the cap together;

The cap can be removed with the second (red) colour now showing instead of the initial first (yellow) colour (indicating that the cap has been opened) and the NFC tag 111 masked behind the side wall 108 of the cap;

The cap can be replaced and closed and the second (red) colour will remain showing (indicating that the cap has been opened at least once) and the NFC tag 111 will remain in a non-readable position.

In this illustrated example, shell 102 and sleeve 106 are fabricated from aluminium, and outer component 104 and inner component 105 are fabricated from a plastics material.

It is to be appreciated that each of the first portion and the second portion of the tamper-evident closure may comprise any number of components, each of which may comprise one or more elements. Each part of the tamper-evident closure may be fabricated from any suitable material or combination of materials and may be manufactured using any suitable method, process or technique or combination of any suitable combination thereof.

It is to be appreciated that the first portion may comprise or be formed as a single component and/or the second portion comprise or be formed as a single component.

In addition, the tamper-evident closure may be provided with more than one window through which a view changes on first opening. A plurality of windows may include windows of the same or different type. A plurality of windows may include windows that have a changing view of the same or different type.

Figure 7:
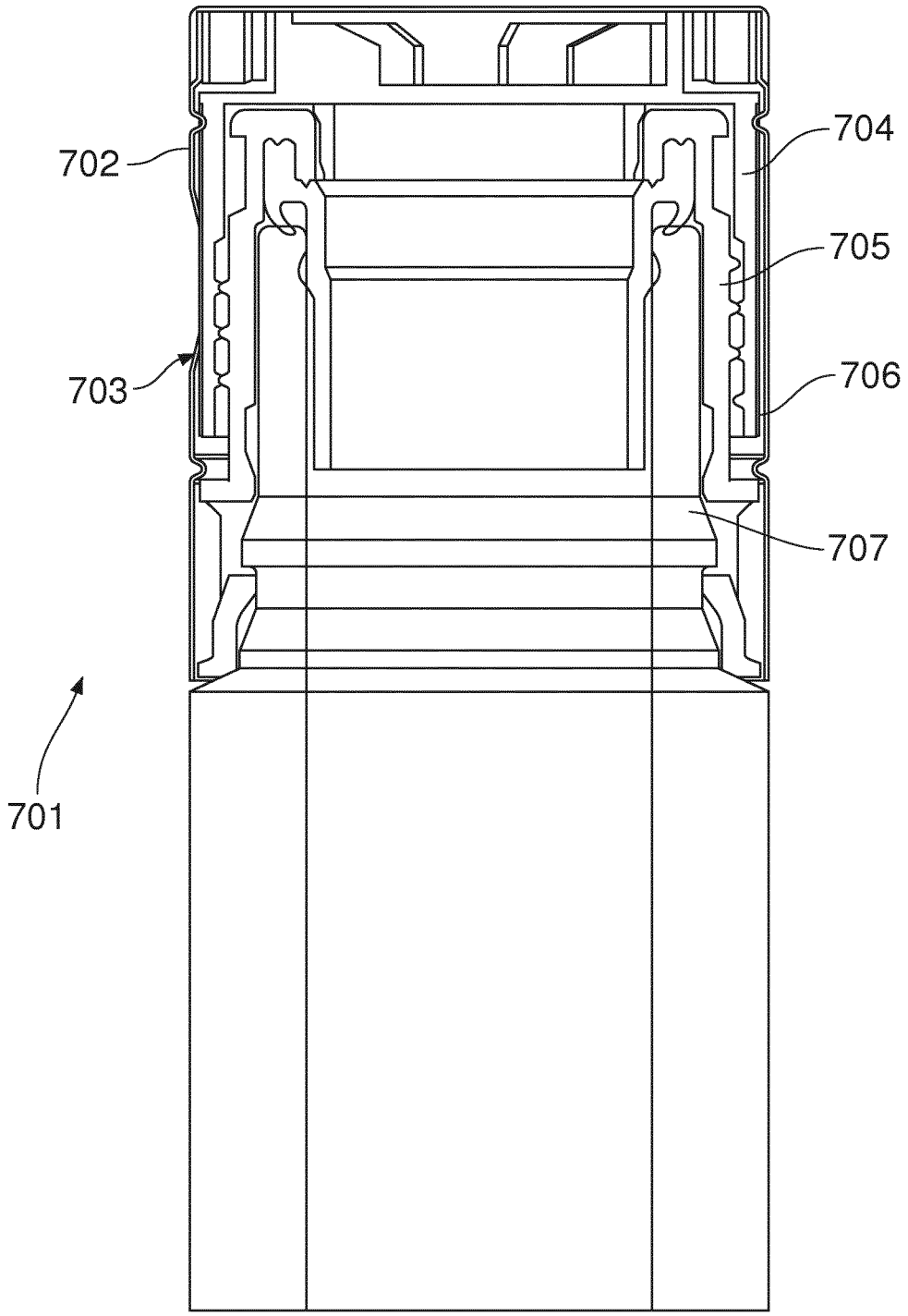
FIG. 7 shows features of a locking mechanism.

FIG. 7 illustrates features of a locking mechanism usable in a closure provided with the changing readability of an RFID device feature described above.

The locking mechanism is shown as part of a tamper-evident closure 701. Similar to tamper-evident closure 101, tamper-evident closure 701 comprises a shell 702 in which a window 703 is defined, an outer component 704, an inner component 705, and a sleeve 706 surrounding the inner component 705. The tamper-evident closure 701 is shown fixed to a container neck 707.

In this embodiment, a first portion of the tamper-evident closure 701 comprises inner component 705 and a second portion of the tamper-evident closure 701 comprises shell 702 and outer component 704.

In an embodiment, the first portion is removably engageable with a body portion of the closure for fixing to a container neck. Alternatively, the first portion is removably engageable with the container neck. The first portion may therefore be indirectly or directly fixed to a container neck.

In an example, a body portion of the closure comprises a pouring fitment. In an example, the pouring fitment comprises a non-return valve.

As will be described in further detail, the locking mechanism comprises a ratchet arrangement. In this embodiment, the locking mechanism comprises an inner ratchet element and an outer ratchet element, the first portion comprises the inner ratchet element and the second portion comprises the outer ratchet element.

In this specific example, inner component 705 is provided with the inner ratchet element and outer component 704 is provided with the inner ratchet element.

Figure 8:
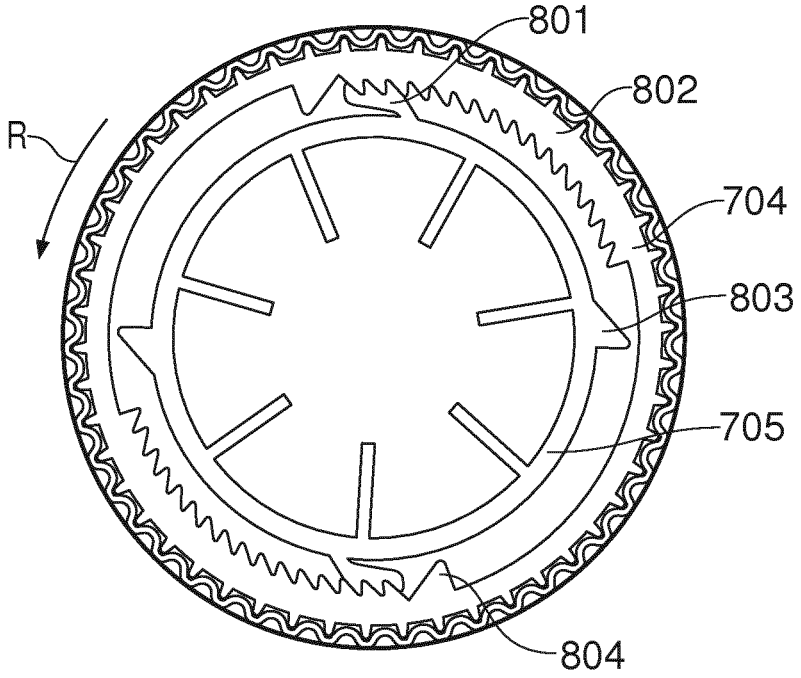
FIG. 8 illustrates the locking mechanism of FIG. 7 in a first condition.
Figure 9:
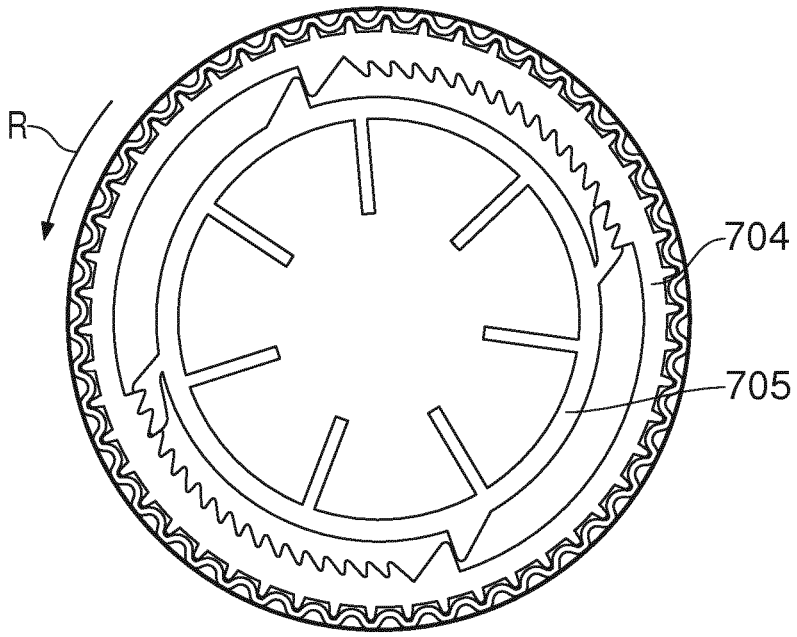
FIG. 9 illustrates the locking mechanism of FIG. 8 in a second condition.

Interengagement between the inner component 705 and the outer component 704 of tamper-evident closure 701 is illustrated in FIGS. 8 & 9.

FIG. 8 illustrates the locking mechanism prior to first opening of the closure. In this Figure, the locking mechanism is shown in a first condition in which the inner and outer components 705, 704 are in a first relative relation. As shown, the inner component 705 comprises first ratchet teeth 801 and the outer component 704 comprises second ratchet teeth 802. In addition, the inner component 705 comprises at least one first ratchet stop 803 and the outer component 704 comprises at least one second ratchet stop 804.

The outer component 704 is shown in a first position in FIG. 8, prior to first opening of the tamper-evident closure 701. During first opening, the outer component 704 is rotated in the opening direction R. The outer component 704 rotates around the inner component 705, and the second ratchet teeth 802 of the outer component ratchet along the first ratchet teeth 801 of the inner component 705. The ratchet engagement between the first and second ratchet teeth 801, 802 prevents the outer component 704 being rotated in the reverse direction, this being the direction of rotation opposite to the opening direction R.

Rotation of the outer component 704 around the inner component 705 from the first position is allowed until a second position is reached, after which the outer component 704 cannot be rotated further relative to the inner component 705.

FIG. 9 illustrates the locking mechanism following initial opening of the closure. In this Figure, the locking mechanism is shown in a second condition in which the inner and outer components 705, 704 are in a second relative relation and the outer component 704 is in a second position.

The outer component 704 is shown having been rotated around the inner component 705 until a second ratchet stop 804 of the outer component 704 has abutted against a first ratchet stop 803 of the inner component 705. The first and second ratchet stops 803, 804 provide an end point to the extent that the outer component 704 can rotate around the inner component 705 from the first position to the second position. In the second condition, the inner and outer components 704, 705 are locked together by the interaction of the first and second ratchet elements of the locking mechanism. The first and second ratchet stops 803, 804 prevent further rotation of the outer component 704 relative to the inner component 705 in the opening direction R and the first and second ratchet teeth 801, 802 prevent reverse rotation of the outer component 704 relative to the inner component 705.

According to the tamper-evident closure 701, during first opening, the shell 702 and the outer component 704 fixed within are rotated around the inner component 705 until the locking mechanism activates and irreversibly locks the first portion and the second portion together, after which continued rotation causes the first and second portions to be together removable from the container neck 707.

Figure 10:
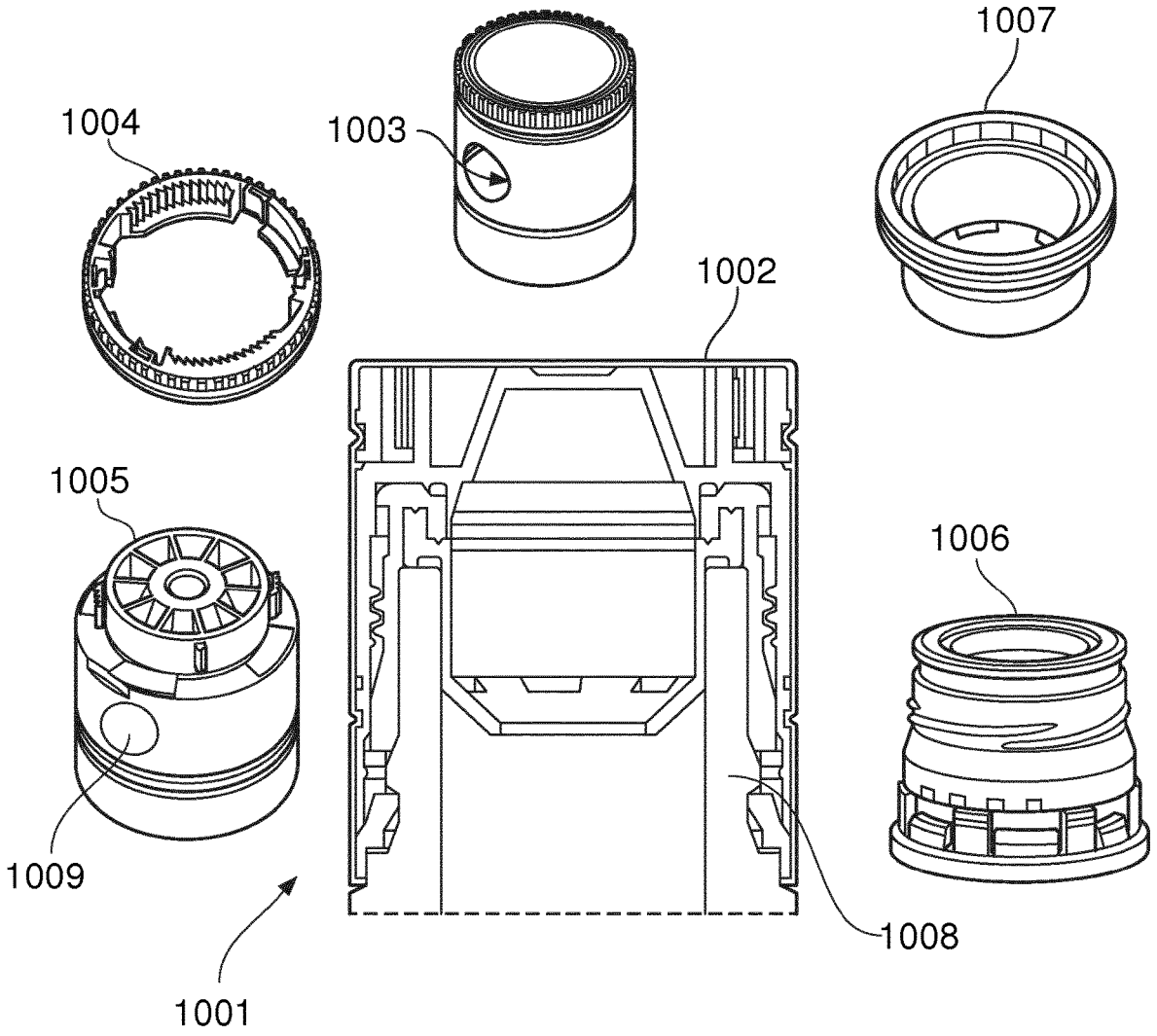
FIGS. 10 & 11 illustrate a further closure according to the present invention.
Figure 11:
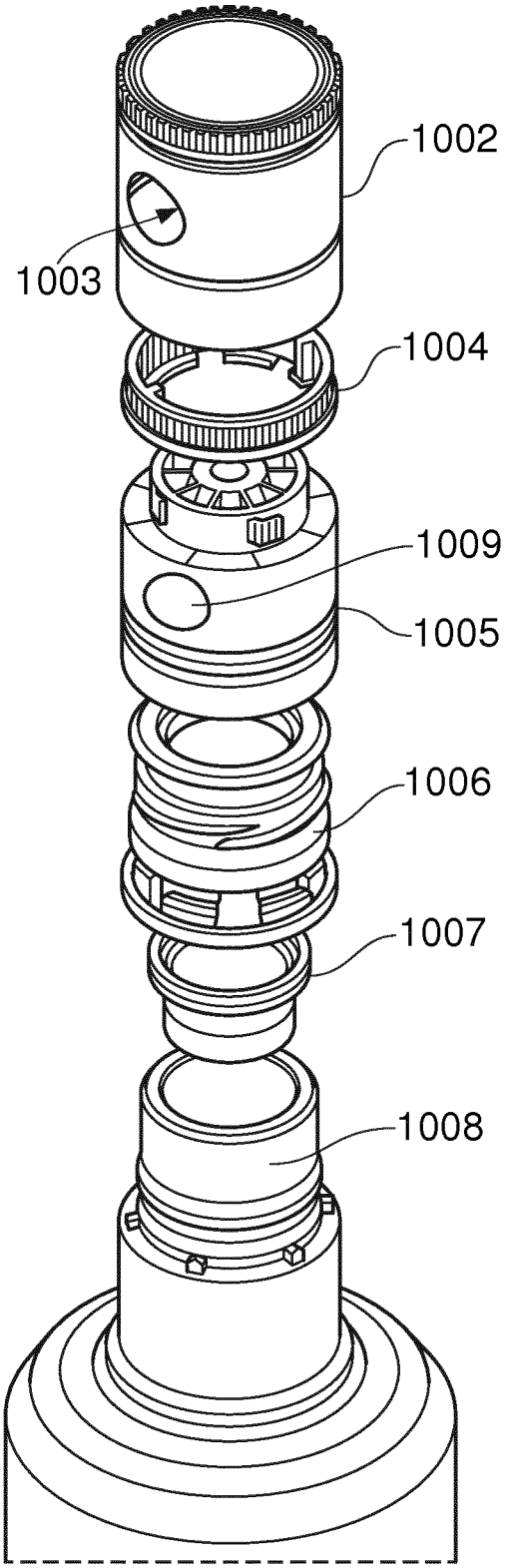

A further embodiment of a tamper-evident closure 1001 is shown in FIGS. 10 & 11.

Similar to tamper-evident closure 101, tamper-evident closure 1001 comprises a first portion and a second portion comprising a window through which a view of the first portion is visible. The tamper-evident closure 1001 comprises a shell 1002 in which a window 1003 is defined, an outer component 1004 and an inner component 1005. According to this example, the first portion comprises the inner component 1005 and additionally comprises a body 1006 and a bucket 1007, for fixing to a container neck 1008. The second portion comprises shell 1002 and outer component 1004.

Unlike the tamper-evident closure 101, in which the view of the first portion through the window 103 comprises a view of the sleeve 106 that is located around the inner component 105, according to tamper-evident closure 1001 the view of the first portion through the window 1003 comprises a view of the inner component 1005. In addition, an RFID device 1009 is carried by the inner component 1005.

The inner component 1005 may be foiled, sprayed or coated or may otherwise carry a visual presentation to provide first and second different views that are visible through the window 1003 before and after first opening of the closure. Alternatively, the presence of the RFID device 1009 may be used to create the different views.

Features of a gap generating mechanism usable in a closure provided with the changing readability of an RFID device feature described above are shown in FIGS. 12 to 15.

Figure 12:
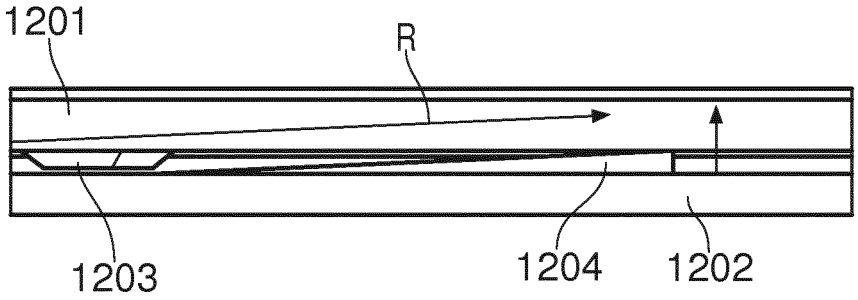
FIGS. 12 to 15 show features of a gap generating mechanism.
Figure 13:
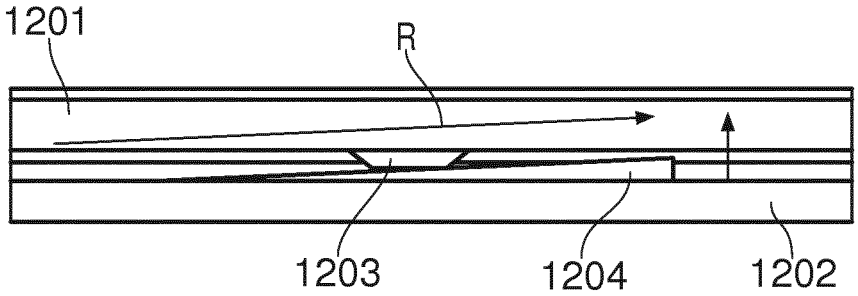
Figure 14:
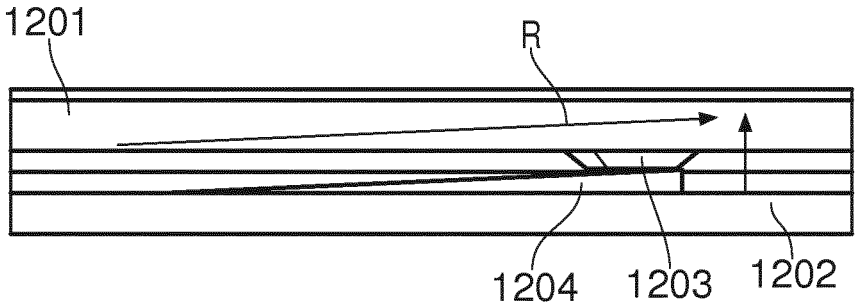
Figure 15:
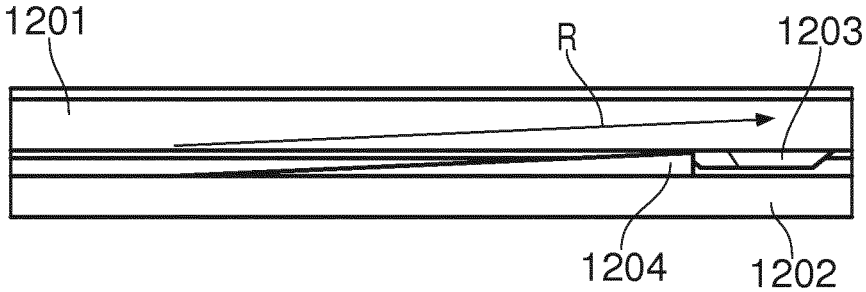

A first part 1201 is rotatable in an opening direction of rotation R relative to a second part 1202. The first part 1201 comprises a downwardly extending lug 1203 and the second part 1202 comprises an upwardly extending ramp 1204 that is inclined to rise vertically in the direction of rotation R. As the first part 1201 is rotated in the direction of rotation R, the lug 1203 rides up the ramp 1204 of the second part 11202, as illustrated in FIGS. 12 and 13, causing the first part 1201 to move vertically away from the second part 1202. As rotation is continued, the lug 1202 reaches the end of the ramp 1204, as illustrated in FIG. 14, after which it can drop down, as illustrated in FIG. 15, allowing the first part 1201 to descend back towards the second part 1202. This gap generating mechanism can be used in a closure having a metal shell provided with frangible bridges or a line of weakness, to cause one shell part to be raised relative to another shell part during first opening of the closure to create a separation between those shell parts that assists the breaking of the frangible bridges or line or weakness and then assists the loosening of tension in the shell.

The first part 1201 may be included in the second portion of the closure and the second part 1202 may be included in the first portion of the closure.

Figure 16:
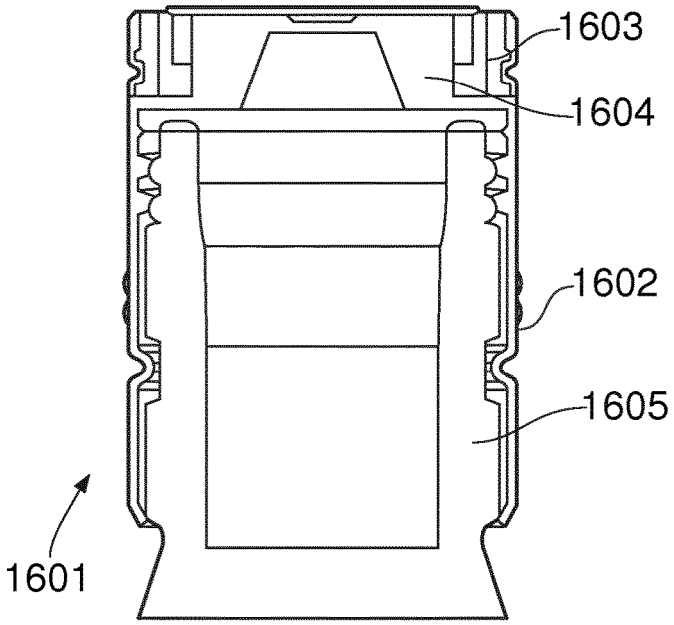
FIGS. 16 and 17 illustrate another closure according to the present invention.
Figure 17:
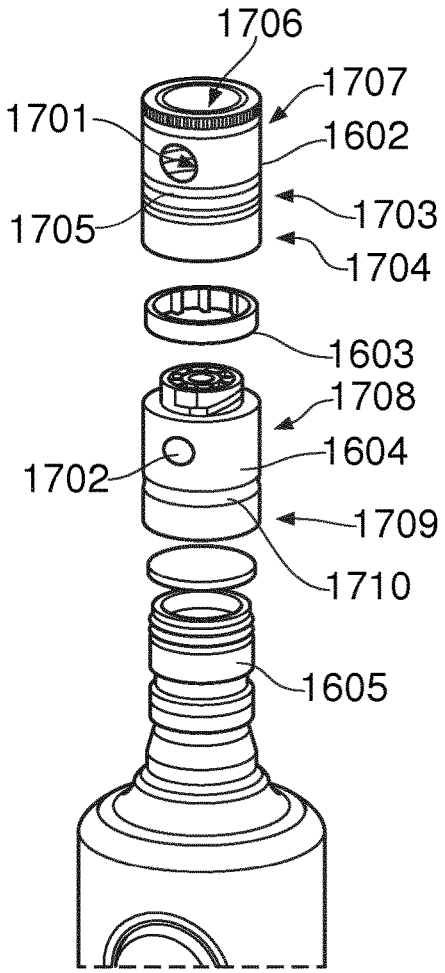

FIGS. 16 & 17 shows features of a further tamper-evident closure 1601, and steps in the opening sequence of the tamper-evident closure 1601 are shown in FIGS. 18 to 21.

Referring to FIGS. 16 & 17, the tamper-evident closure 1601 comprises a metal shell 1602, an outer ratchet component 1603 and an inner ratchet component 1604. The metal shell 1602 defines a window 1701. The tamper-evident closure 1601 is shown in FIG. 16 fixed to a container neck 1605. As can be seen in FIG. 17, the outer ratchet component 1604 is provided with an RFID tag 1702. The metal shell 1602 defines a removable cap part 1703 and a captive part 1704, which in this example are initially joined together by a line of weakness 1705 that breaks during first opening of the tamper-evident closure 1601. The removable cap part 1703 has a top plate 1706 and a side wall 1707 that depends from the top plate 1706 and in which the window 1701 is defined. In this example, the inner ratchet component 1604 similarly defines an upper, removable part 1708 and a lower, captive part 1709, which in this example are initially joined together by a line of weakness 1710 that breaks during first opening of the tamper-evident closure 1601.

Figure 18:
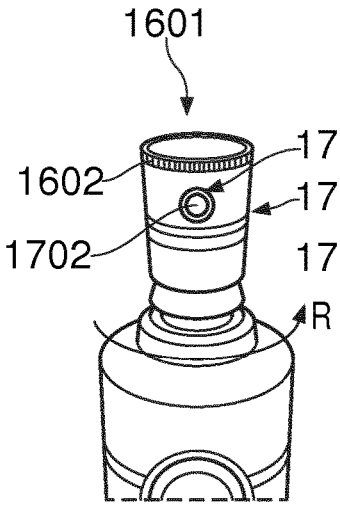
FIGS. 18 to 21 show steps in an opening sequence of the closure of FIGS. 16 and 17.
Figure 19:
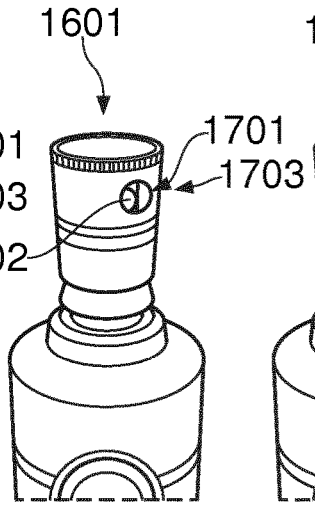
Figure 20:
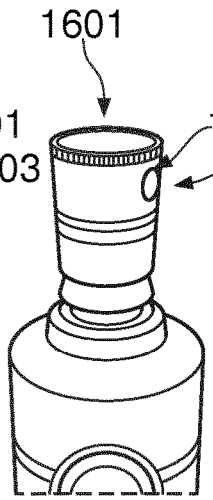

The tamper-evident closure 1601 is shown in FIG. 18 prior to first opening. Before initial opening of the tamper-evident closure 1601, the RFID tag 1702 can be read by bringing an appropriately enabled reading device within range of the window 1701. It can be seen that the RFID tag 1702 is visible through the window 1701 of the removable cap part 1703 of the metal shell 1602. To initiate opening of the tamper-evident closure 1601, the removable cap part 1703 of the metal shell 1602 is rotated in the direction of rotation R. In FIG. 19, the tamper-evident closure 1601 is shown after an initial period of rotation of the removable cap part 1703 of the metal shell 1602. It can be seen that the RFID tag 1701 has moved partially behind the side wall 1707 of the removable cap part 1703 of the metal shell 1602. Referring now to FIG. 20, the tamper-evident closure 1601 is shown after a further period of rotation of the removable cap part 1703 of the metal shell 1602 has resulted in the inner and outer ratchet components 1604, 1603 becoming locked together and in the RFID tag 1702 being moved fully behind the side wall 1707. The RFID tag 1702 can no longer be read by bringing an appropriate reading device within range of the window 1701. The side wall 1707 of the removable cap part 1703 of the metal shell 1602 covers the RFID tag 1702 and shields the RFID tag 1702 from electromagnetic waves. In this way, the readability of the RFID tag 1702 is blocked by the metal shell 1602.

Figure 21:
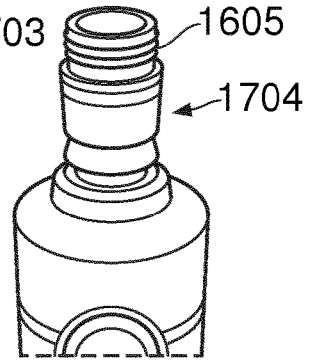

FIG. 21 illustrates the container neck 1605 after the removable cap part 1703 of the tamper-evident closure 1601, complete with the locked together upper, removable part 1708 of the inner ratchet component 1604 and the outer ratchet component 1603, has been removed therefrom. As shown, the captive part 1704 of the shell 1602, along with the lower, captive part 1709 of the inner ratchet component 1604, remains on the container neck 1605. The removable cap part 1703, together with the locked together upper, removable part 1708 of the inner ratchet component 1604 and the outer ratchet component 1603, can subsequently be replaced on the container neck 1605; however, the RFID tag 1702 remains masked and still cannot be read.

In some embodiments an irreversible gap generation mechanism may be included. The irreversible gap generation mechanism may comprise a ratchet arrangement. It is to be appreciated that a tamper-evident closure as described herein may comprise a lateral and/or a longitudinal ratchet arrangement.

In an embodiment, the tamper-evident closure comprises a first part and a second part, when the first and second portions are in the first relative relation, prior to first opening of the tamper-evident closure, the first and second parts are adjacent one another, and when the first and second portions are moved into the second relative relation, during first opening of the tamper-evident closure, an irreversible gap is generated between the first and second parts.

In an example, the first and second parts are lower and upper shell parts.

In a preferred example, the gap is an unobstructed gap. In other words, two parts of the closure are held apart without the requirement an obstruction trapped or otherwise held between them. In an alternative example, the gap is an obstructed gap.

Figure 22:
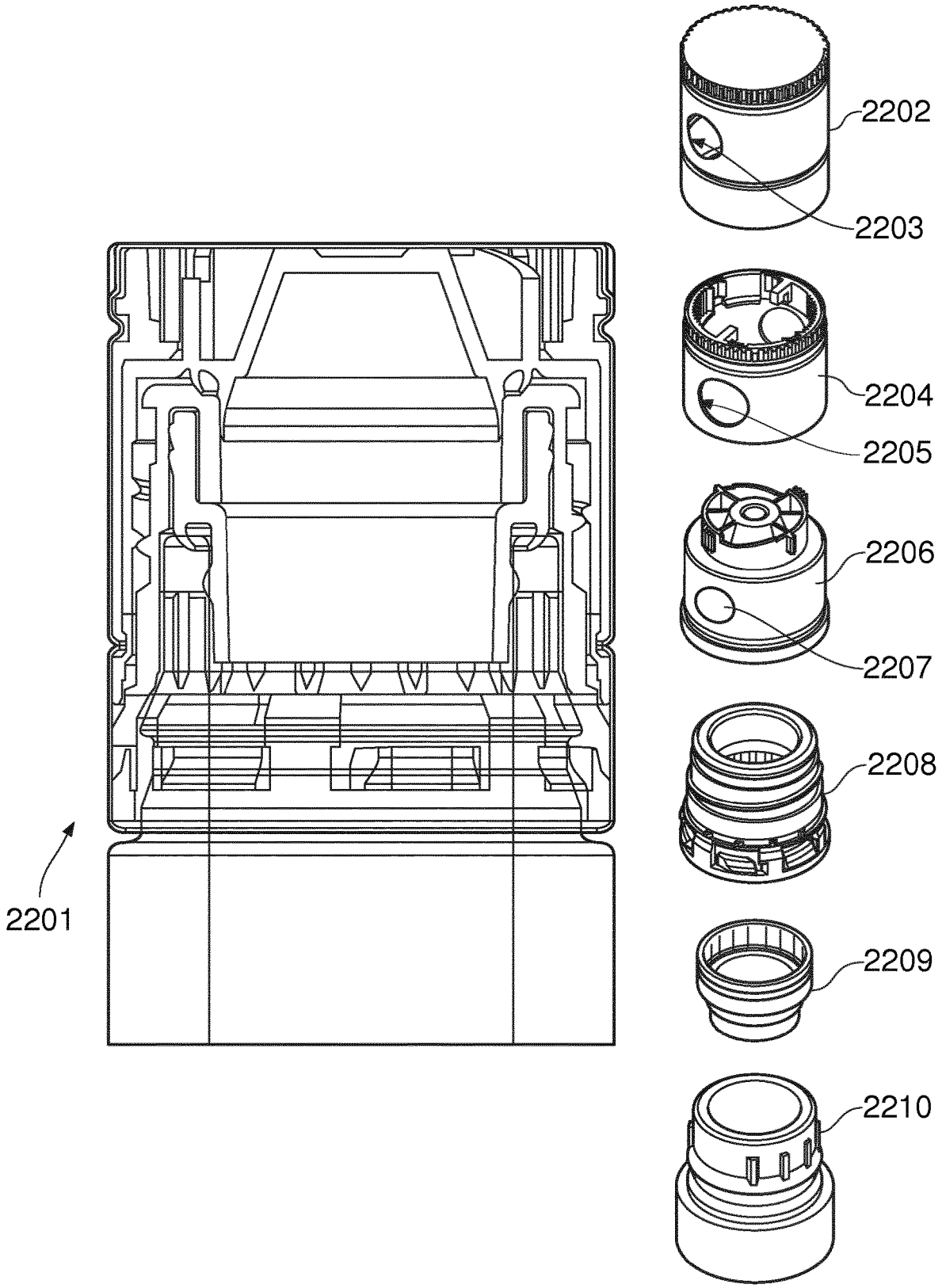
FIG. 22 illustrates yet another according to the present invention.

Another embodiment of tamper-evident closure 2201 is shown in FIG. 22. The tamper-evident closure 2201 has all of a changing view tamper-evident feature as described above, a changing readability of an RFID device as described above and an irreversible gap generation feature as described above.

The arrangement of tamper-evident closure 2201 includes a metal shell 2202 comprising a window 2203, an outer ratchet component 2204 comprising a window 2205 that corresponds to the window 2203 of the shell 2202 and an inner ratchet component 2206 that is provided with an RFID device 2207. The arrangement also optionally comprises a body 2208 and a bucket 2209. This Figure also shows a container neck finish 2209.

A first portion of the tamper-evident closure 2201 includes the shell 2202 and the outer ratchet component 2204, which are fixed together, with the respective windows 2203, 2205 aligned. The second portion of the tamper-evident closure 2201 includes at least the inner ratchet component 2206.

Figure 23:
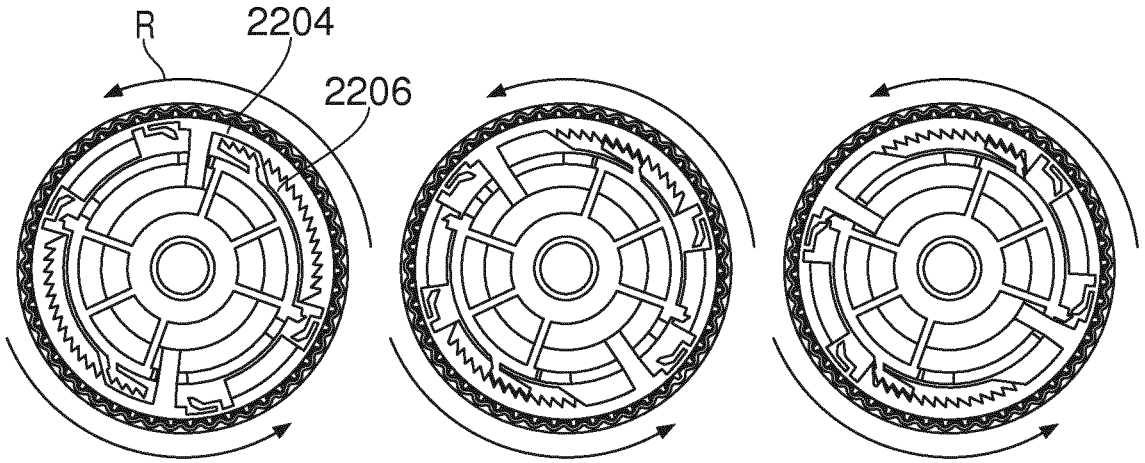
FIGS. 23 to 25 show steps in an opening sequence of the closure of FIG. 22.
Figure 23:
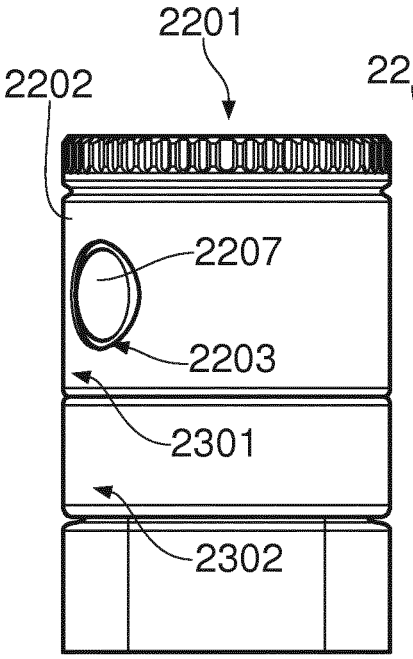
Figure 24:
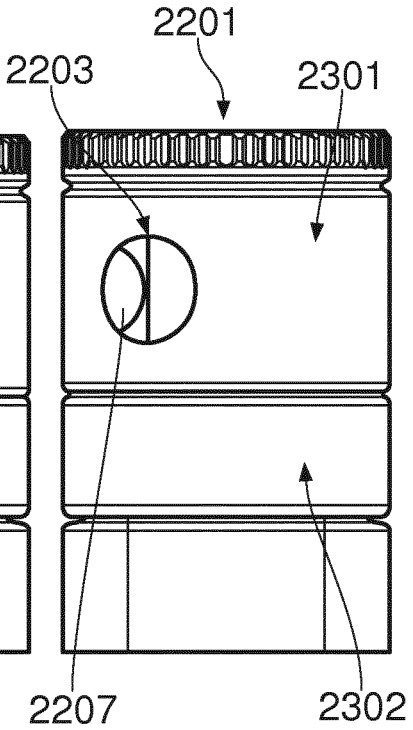
Figure 25:
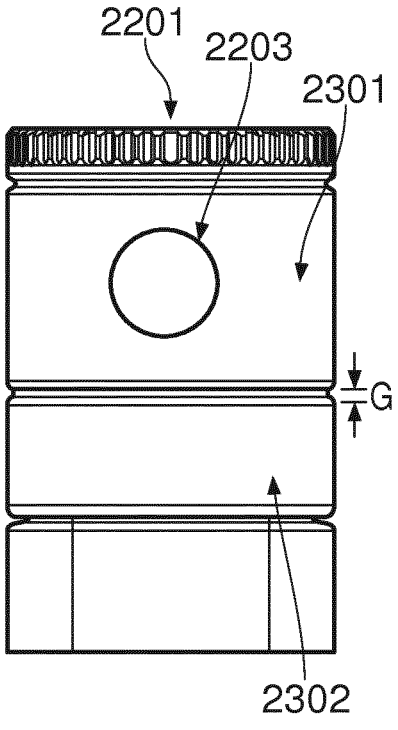

Steps in an opening sequence of the tamper-evident closure 2201 are shown in FIGS. 23 to 25, during which the view through the windows 2203, 2205 irreversibly changes, an alignment of the RFID device 2207 with the windows 2203, 2205 irreversibly changes.

As can be seen in FIG. 23, the shell 2202 of the tamper-evident closure 2201 comprises an upper shell part 2301 and a lower shell part 2302. The window 2203 of the shell 2202 is defined in the upper shell part 2301.

The tamper-evident closure 2201 is shown prior to first opening in FIG. 23. It can be seen that the upper shell part 2301 is initially adjacent the lower shell part 2302. The upper shell part 2301 and lower shell part 2302 may be joined along a line of weakness. As shown, the RFID tag 2207 is aligned with the window 2203 of shell 2202 and can be read using an appropriate reader.

To initiate opening of the tamper-evident closure 2201, the upper shell part 2301 is rotated in the opening direction R. In FIG. 24, it can be seen that the position of the upper shell part 2301 relative to the lower shell part 2302 has changed. In addition, vertical separation of the upper shell part 2301 from the lower shell part 2302 has begun. Further, in this example, the view through the window 2203 has altered.

FIG. 25 shows the tamper-evident closure 2201 after the upper shell part 2301 has been rotated further to a position in which the inner and outer ratchet components 2206, 2204 have locked the first and second portions of the tamper-evident closure 2201 together. In addition, an irreversible gap G has been generated between the upper shell part 2301 and the lower shell part 2302. Further, the view through the window 2203 has irreversibly changed and the RFID tag 2207 is no longer aligned with the window 2203 and can no longer be read.

Figure 26:
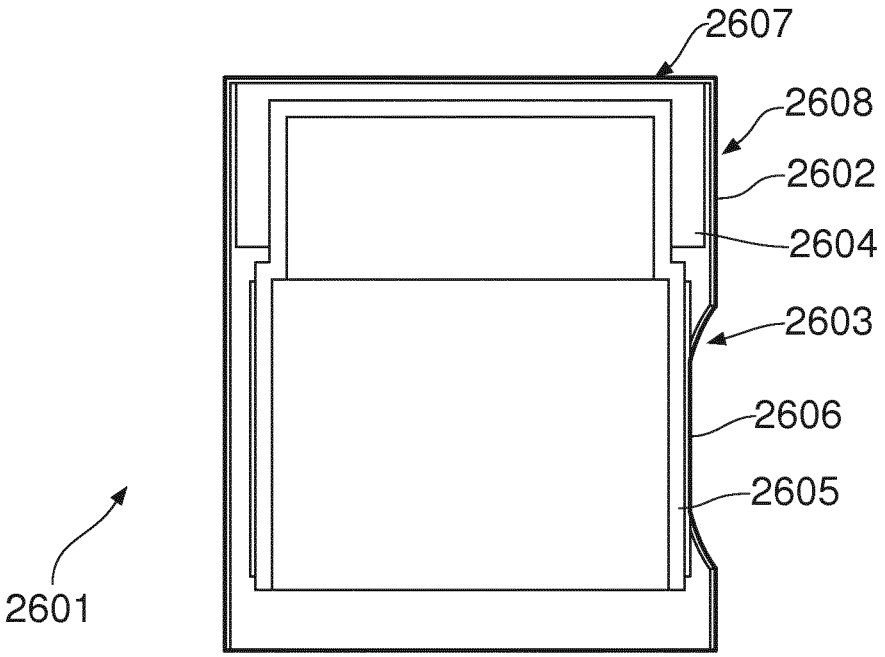
FIG. 26 shows a first view of a closure according to another embodiment of the present invention.
Figure 27:
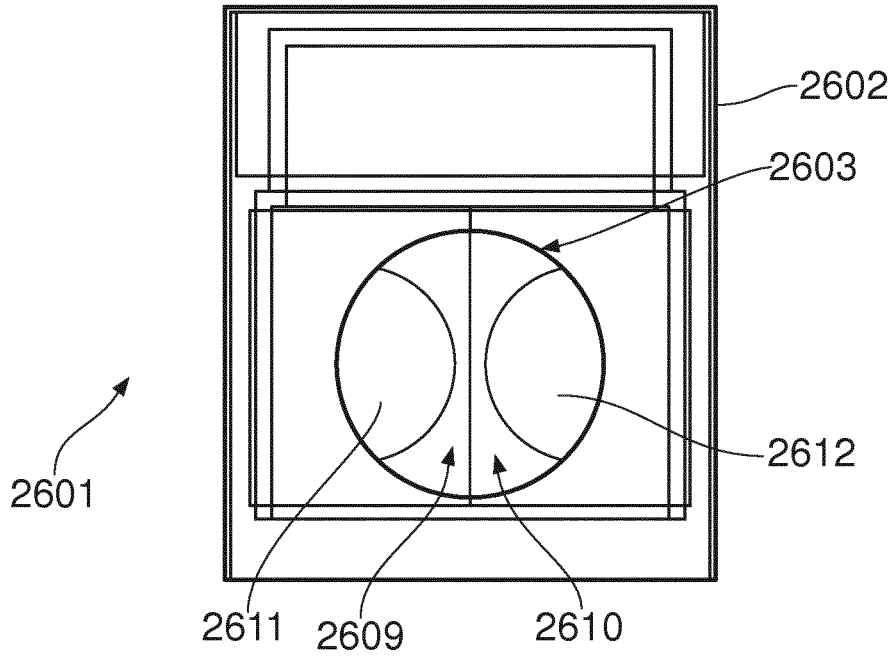
FIG. 27 shows a second view of the closure of FIG. 26.

A tamper-evident closure 2601 is shown in FIGS. 26 & 27. Tamper-evident closure 2601 is similar to the tamper-evident closure 101 of FIGS. 1 to 6 with a difference that will now be described.

Tamper-evident closure 2601 comprises a metal shell 2602 in which a window 2603 is defined, an outer component 2604, an inner component 2605 and a sleeve 2606 that surrounds the inner component 2605. In this example, the shell 2602 comprises a top plate 2607 and a side skirt 2608 that depends from the top plate 2607, the window 2603 being defined in the side skirt 2608.

The sleeve 2606 comprises a first zone 2609 and a second zone 2610 that is different from the first zone 2609. In this example, the first zone 2609 has a first appearance and the second zone 2610 has a second appearance that differs from the first appearance of the first zone 2609.

Each zone of the sleeve is associated with an RFID device, which is preferably an NFC device.

Thus, according to the present embodiment, the first zone 2609 of sleeve 2606 is provided with a first RFID device 2611 and the second zone 2610 of sleeve 2606 is provided with a second RFID device 2612.

The outer component 2604 is rotatable around the inner component 2605. A first portion of the tamper-evident closure 2601 comprises inner component 2605 and sleeve 2606 and a second portion of the tamper-evident closure 2601 comprises metal shell 2602 and outer component 2604.

With the shell 2602 and outer component 2604 in fixed relative relation and with the sleeve 2606 and inner component 2605 also in fixed relative relation and prevented from rotating, rotation of the metal shell 2602 causes rotation of the window 2603 relative to the sleeve 2606.

Thus, in this embodiment, rotation of the second portion 2602, 2604 relative to the first portion 2605, 2606 causes rotation of the window 2603 relative to the first portion 2605, 2606.

The second portion 2602, 1264 is rotatable relative to the first portion 2605, 2606 upon first opening of the tamper-evident closure 2601 from a first position in which the first and second portions 2605, 2606; 2602, 2604 are in a first relative relation to a second position in which the first and second portions 2605, 2606; 2602, 2604 are in a second relative relation. The tamper-evident closure 2601 comprises a locking mechanism (not shown) for irreversibly locking the first portion and second portions 2605, 2606; 2602, 2604 in the second relative relation.

As will be described in further detail, when the first and second portions 2605, 2606; 2602, 2604 are in the first relative relation, the first NFC tag 2611 is aligned with the window 2603 and is readable and the second NFC tag 2612 is masked behind the metal shell 2602 and is not readable and when the first and second portions 2605, 2606; 2602, 2604 are in the second relative relation, the second NFC tag 2612 is aligned with the window 2603 and is readable and the first NFC tag 2611 is masked behind the metal shell 2602 and is not readable.

Figure 28:
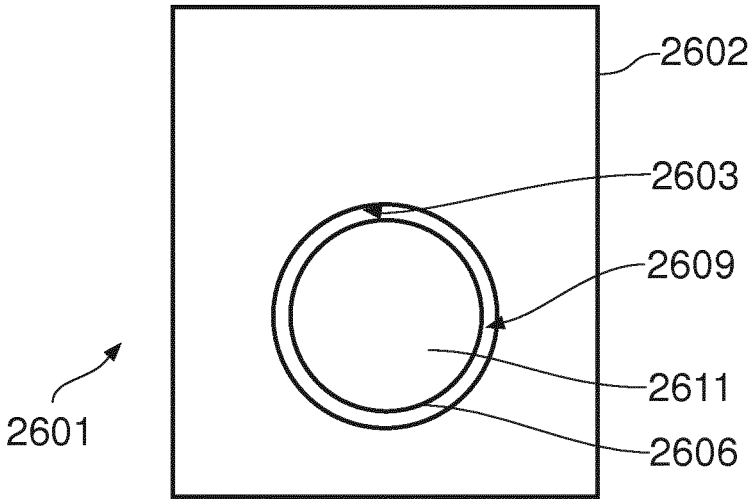
FIGS. 28 to 30 show steps in an initial opening of the closure of FIGS. 26 and 27.

FIG. 28 shows tamper-evident closure 2601 prior to first opening. Before the tamper-evident closure 2601 has been opened for the first time, the first and second portions of the tamper-evident closure 101 are in a first relative relation and the first RFID device 2610 of associated with the first zone 2609 of the sleeve 2606 is aligned with the window 2603 of the metal shell 202. In this illustrated example, when the first and second portions are in the first relative relation, the view of the first portion that is visible through the window 2603 of the metal shell 2602 comprises only a region of the first zone 2609 of the sleeve 2606.

When the first and second portions are in the first relative relation, the first RFID device 2610 associated with the first zone 109 of the sleeve 106 is aligned with the window 103 and is readable.

To open the tamper-evident closure 2601, the metal shell 2602 is rotated, which causes the window 2603 to be rotated around sleeve 2606.

Figure 29:
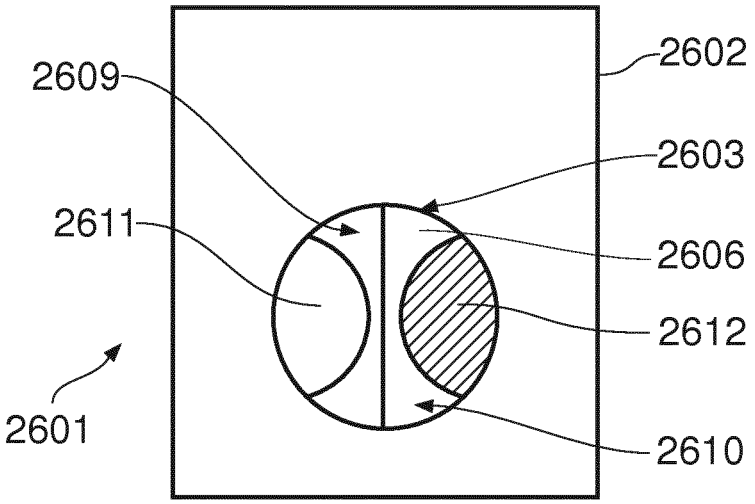

FIG. 29 shows tamper-evident closure 2601 at a first stage during first opening. As shown, the metal shell 2602 has been rotated from the first position shown in FIG. 28, in which the first and second portions are in a first relative relation before opening of the tamper-evident closure 2601, towards a second position, in which the first and second portions are in a second relative relation. In FIG. 29, the metal shell 102 is shown at an intermediate position, between the first position and the second position.

It can be seen from comparison of FIGS. 28 & 29 that the view of the first portion that is visible through the window 2603 has changed, following the change of position of the metal shell 2602. Following rotation of the metal shell 2602 to the intermediate position shown in FIG. 29, the view through the window 2603 comprises a region of the first zone 2609 of the sleeve 2606 and also a region of the second zone 2610 of the sleeve 2606. In this specific example, each of the first RFID device 2611 and the second RFID device 2612 are both partially exposed within the window 2603 and partially masked by the metal shell 2602. The action of rotating the metal shell 2602 from the position shown in FIG. 28 to the position shown in FIG. 29 has caused the first RFID device 2611 to be moved away from a position of alignment with the window 2603 and has caused the second RFID device 2612 to be moved towards a position of alignment with the window 2603.

Figure 30:
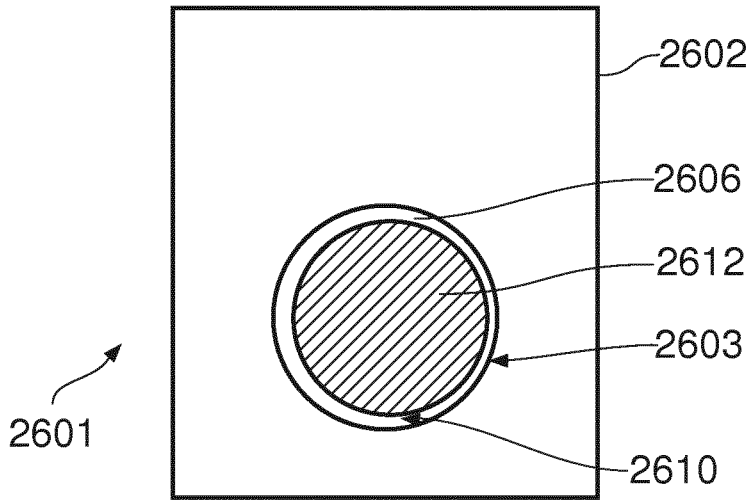

FIG. 30 shows tamper-evident closure 2601 at a second, subsequent stage during first opening. At the shown second stage, the metal shell 2602 has been rotated from the intermediate position shown in FIG. 29, into the second position, in which the first and second portions are in a second relative relation.

It can be seen from comparison of FIGS. 29 & 30 that the view of the first portion that is visible through the window 2603 has changed again, following the change of position of the metal shell 2602.

Following rotation of the metal shell 2602 to the intermediate position shown in FIG. 30, the view through the window 2603 comprises only a region of the second zone 2610 of the sleeve 2606.

When the first and second portions are in the second relative relation, the second RFID device 2612 associated with the second zone 2610 of the sleeve 2606 is aligned with the window 2603 and is readable.

Thus, when the first and second portions move from the first relative relation shown in FIG. 28 to the second relative relation shown in FIG. 30, the first RFID device 2610 associated with the first zone 2609 of the sleeve 2610 moves from a position in which it is readable into a position in which it is not readable and the second RFID device 2612 associated with the second zone 2610 of the sleeve 2610 moves from a position in which it is not readable into a position in which it is readable.

In this embodiment, the first RFID device 2610, when exposed, can be read to confirm a 'sealed' status of a container provided with the closure 2601 and the second RFID device 2610, when exposed, can be read to confirm an 'open' status.

When a particular product is provided with a closure in which an RFID device is expected to be detectable, the inability to detect an RFID device is indicative of tampering or a non-original product.

Thus, a closure may be provided with first and second RFID devices and a window, before first opening of the closure a first of the RFID devices may be in register with the window and the second of the RFID devices may be out of register with the window, and upon first opening of the closure the first of the RFID devices may be moved out of register with the window and the second of the RFID devices may be moved into register with the window. Alternatively, a closure may be provided with first and second RFID devices and first and second windows, before first opening of the closure a first of the RFID devices may be in register with a first window and the second of the RFID devices may be out of register with the second window, and upon first opening of the closure the first of the RFID devices may be moved out of register with the first window and the second of the RFID devices may be moved into register with the second window.

Thus, a tamper-evident closure as described herein comprises at least one RFID device associated with the first portion, in which the RFID device is aligned with the window of the second portion when the first and second portions are in the first relative relation and is readable, and the RFID device is masked by the second portion when the first and second portions are in the second relative relation and is not readable, whereby the readability of the RFID device is irreversibly blocked during first opening of the tamper-evident closure.

The or each RFID device may store any desired data relating to any one or more aspects of an item.

Although illustrative embodiments and examples of the invention have been disclosed in detail herein, with reference to the accompanying drawings, it is to be understood that the invention is not limited to the precise embodiment and examples shown and/or described and that various changes and modifications can be effected therein by one skilled in the art without departing from the scope of the invention as defined by the appended claims.

The invention claimed is:

1. A tamper-evident closure for a container neck, the tamper-evident closure comprising:

a first portion, and a second portion comprising a window through which a view of the first portion is visible;

the second portion rotatable relative to the first portion upon first opening of the tamper- evident closure, in a first direction of rotation, from a first position in which the first and second portions are in a first relative relation to a second position in which the first and second portions are in a second relative relation; and a locking mechanism for irreversibly locking the first and second portions in the second relative relation;

rotation of the second portion relative to the first portion causes rotation of the window relative to the first portion, a first view of the first portion is visible through the window when the first and second portions are in the first relative relation, and a second, different view of the first portion is visible through the window when the first and second portions are in the second relative relation;

wherein the tamper-evident closure further comprises an RFID device associated with the first portion, the RFID device is aligned with the window of the second portion when the first and second portions are in the first relative relation and is readable, and the RFID device is masked by the second portion when the first and second portions are in the second relative relation and is not readable;

whereby the readability of the RFID device is irreversibly blocked during first opening of the tamper-evident closure, further comprising a second RFID device associated with the first portion, when the first and second portions are in the first relative relation, the RFID device is aligned with the window of the second portion and is readable and the second RFID device is masked by the second portion and is not readable, and when the first and second portions are in the second relative relation, the RFID device is masked by the second portion and is not readable and the second RFID device is aligned with the window of the second portion and is readable;

whereby the readability of the RFID device and of the second RFID device is irreversibly changed during first opening of the tamper-evident closure.

2. The tamper-evident closure of claim 1, wherein, during first opening of the tamper-evident closure, the locking mechanism irreversibly locks the first portion and the second portion in the second relative relation and thereafter the first and second portions are removable together.

3. The tamper-evident closure of claim 1, wherein the second portion comprises a shell in which the window is defined.

4. The tamper-evident closure of claim 3, wherein the shell comprises a top plate and a side skirt and the window is defined in the side skirt.

5. The tamper-evident closure of claim 4, wherein the window is one of: an aperture, a cut-out.

6. The tamper-evident closure of claim 3, wherein the shell comprises aluminium.

7. The tamper-evident closure of claim 3, wherein the first portion comprises a sleeve, the sleeve comprising a first zone provided with the RFID device and the sleeve comprising a second zone that differs from the first zone.

8. The tamper-evident closure of claim 7, wherein the sleeve comprises a plastics material.

9. The tamper-evident closure of claim 1, wherein the locking mechanism comprises a ratchet arrangement.

10. The tamper-evident closure of claim 9, wherein the locking mechanism comprises an inner ratchet element and an outer ratchet element, the first portion comprises the inner ratchet element and the second portion comprises the outer ratchet element.

11. The tamper-evident closure of claim 1, comprising a first part, and a second part, when the first and second portions are in the first relative relation, prior to first opening of the tamper-evident closure, the first and second parts are adjacent one another, and when the first and second portions are moved into the second relative relation, during first opening of the tamper-evident closure, an irreversible gap is generated between the first and second parts.

12. The tamper-evident closure of claim 11, wherein the first and second parts are upper and lower shell parts.

13. The tamper-evident closure of claim 11, wherein the gap is unobstructed.

14. The tamper-evident closure of claim 1, wherein the first portion is removably engageable with a body portion for fixing to a container neck.

15. The tamper-evident closure of claim 1, wherein the window comprises more than one opening.

16. The tamper-evident closure of claim 1, wherein said second RFID device is an NFC tag.

17. A container neck provided with the tamper-evident closure of claim 1.

* * * * *